United States Patent [19]

Brophy et al.

[11] 3,998,118

[45] Dec. 21, 1976

[54] ROLL FED COPIER

[75] Inventors: William R. Brophy, West Simsbury; Richard G. Dolson, Canton, both of Conn.

[73] Assignee: Royal Business Machines, Inc., Hartford, Conn.

[22] Filed: Apr. 15, 1976

[21] Appl. No.: 677,270

Related U.S. Application Data

[63] Continuation of Ser. No. 522,319, Nov. 8, 1974, abandoned.

[52] U.S. Cl. ..... 83/205; 83/224; 83/367; 83/372; 83/586; 355/13; 355/28

[51] Int. Cl.[2] ..... G03G 15/00; B26D 5/20

[58] Field of Search ..... 83/203, 205, 283, 365, 83/367, 372, 436, 586, 587, 373, 224; 355/13, 28, 29

[56] References Cited

UNITED STATES PATENTS

| | | | |
|---|---|---|---|
| 2,973,678 | 3/1961 | Scott et al. | 83/373 X |
| 3,398,619 | 8/1968 | Nichols et al. | 83/372 X |
| 3,495,822 | 2/1970 | Cederbaum | 355/13 X |
| 3,572,203 | 3/1971 | Woodham et al. | 83/587 X |
| 3,653,757 | 4/1972 | Newcomb | 355/13 |
| 3,722,340 | 3/1973 | Kobayashi | 83/203 |
| 3,779,114 | 12/1973 | Rabin | 355/13 X |

*Primary Examiner*—Willie G. Abercrombie

*Attorney, Agent, or Firm*—Joseph R. Spalla

[57] ABSTRACT

A roll fed copier is provided with mechanism responsive to depression of a copy button to start or turn on power to the machine and thereby initiate the feed of copy paper from a supply roll and to cock a sprng-powered knife which is tripped by linkage operated by an adjustable copy length control on the movable original carrying platen. Additional mechanism is also provided to break the power lines to the machines if the copy button is not actuated for a predetermined interval.

10 Claims, 6 Drawing Figures

ROLL FED COPIER

This is a continuation of application Ser. No. 522,319 filed Nov. 8, 1974, now abandoned.

This invention relates to copy machines; more particularly, it relates to copy machines fitted with a roll supply of copy paper and a cutter bar to cut lengths as determined by a copy length control; and specifically, it relates to a copier having a spring-powered cutter bar or knife which is cocked incident to depression of a copy button and triggered by the adjustable copy length control.

A number of copy machines are in current use which utilize precut photosensitive sheets which are fed into the machine for charging, exposure and development. Also in use are machines which carry a roll of photosensitive paper which is drawn into the machine and cut to lengths corresponding to the length of the original being copied. Most of the latter types of machines employ complicated systems including power solenoids to operate the knife at the proper time in a cycle and such systems are not easily integrated in a precut sheet machine without major redesign where conversion of a precut sheet machine to a roll fed machine is desired.

Accordingly, an object of the invention is to enable the conversion of a sheet fed to a roll fed copy machine with a minimum of redesign.

Another object of the invention is to provide a simple spring-powered cutter bar which is mechanically cocked early in a machine cycle initiated by depression of copy button, and released to cut copy paper by an adjustable copy length control on the machine platen.

A feature of the invention resides in a mechanical timer which is released to begin time measurement incident to each depression of a copy button and in so doing turn on the machine. If the copy button is not depressed for a predetermined interval, the timer turns the machine off. Accordingly, another object of the invention is to provide a simple means associated with a copy button which turns the machine on and if the machine is not used for a time, turns the machine off.

Another object is to integrate the machine on and copy cycle controls in one operator button.

Other objects and many of the attendant advantages of this invention will become understood by reference to the following detailed description when considered in connection with the accompanying drawing in which like reference numerals designate like or corresponding parts throughout the figures thereof and wherein.

Figure 1:
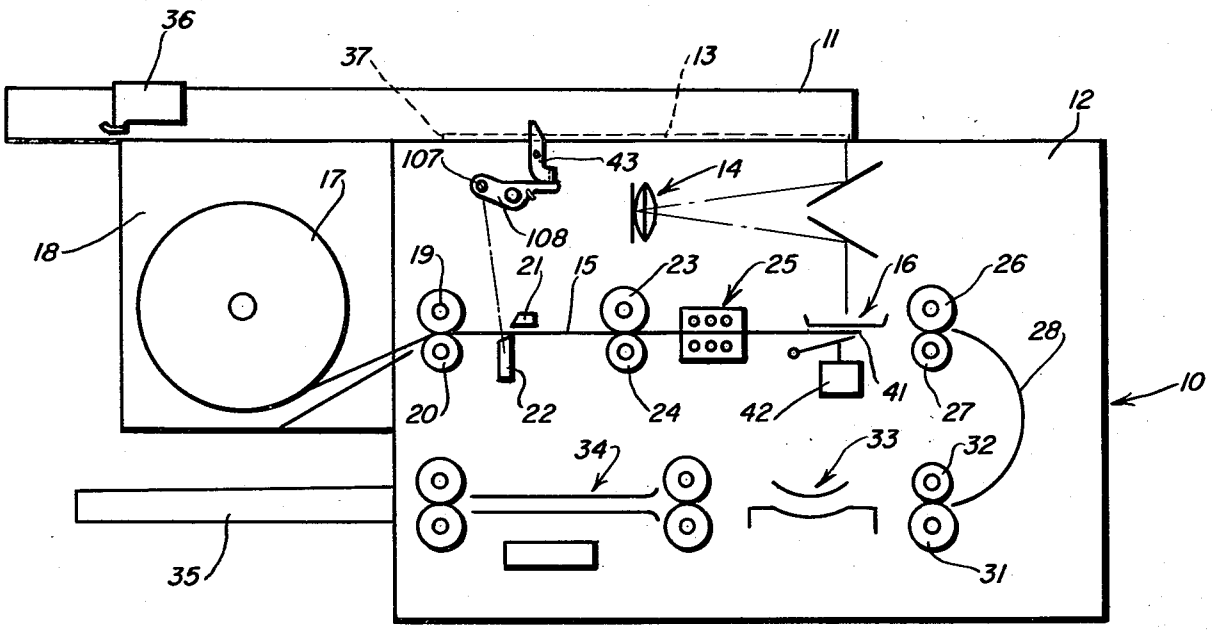
FIG. 1 is an overall side elevation of a copy machine showing elements of the invention.

Referring now to the drawing wherein like reference characters designate like or corresponding parts throughout the several views thereof, there is shown in FIG. 1 a copy machine 10 which is like the electrostatic copier marketed by and described in Royfax Model 1400 and 1400M Service Guide issued by the Royal Typewriter Company Division of Litton Industries, copyright 1973, except for the substitution of the present invention for the sheet feed and actuating mechanisms thereof.

The copy machine comprises an original platen 11 movably supported on a base 12 whereby movement of the platen 11 to the right as viewed in FIG. 1 causes an original 13 to be scanned by optics, generally designated by reference 14, which direct the image to expose photosensitive paper 15 moving through an exposure station generally designated 16. In accordance with the invention, the photosensitive paper 15 is stored in a roll 17 housed in a compartment 18 and is pulled therefrom by a pair of entry feed rollers 19, 20 past a shear comprising a stationary knife 21 and a movable cutter bar or knife 22 and then is conveyed by a second pair of feed rollers 23, 24 through a charge corona unit 25 and past the exposure station 16 from whence it is directed and guided by upper turn around rollers 26, 27, guide 28 and lower turn around rollers 31, 32 to a developing station 33 and then to a drying station 34 from which copy exits to a tray 35.

In making a copy, the original 13 to be copied is placed on the movable platen 11 and a copy length adjustor 36 in accordance with the invention, located on and slidably adjustable relative to the platen 11, is set to a position corresponding to the position of the trailing edge 37 of the original 13. Depression of a copy button 38 (FIG. 2) turns the machine on and initiates a machine cycle during which copy paper 15 is drawn off the roll 17 by feed rollers 19, 20 and fed via feed rollers 23, 24 to the exposure station 16 where the lead edge 41 trips a microswitch 42 to initiate platen movement to scan the original 13. When the copy length adjuster 36 on the platen 11 encounters a pivotable lever 43, the movable knife 22 operates to cut the photosensitive paper 15 to the set length.

Figure 2:
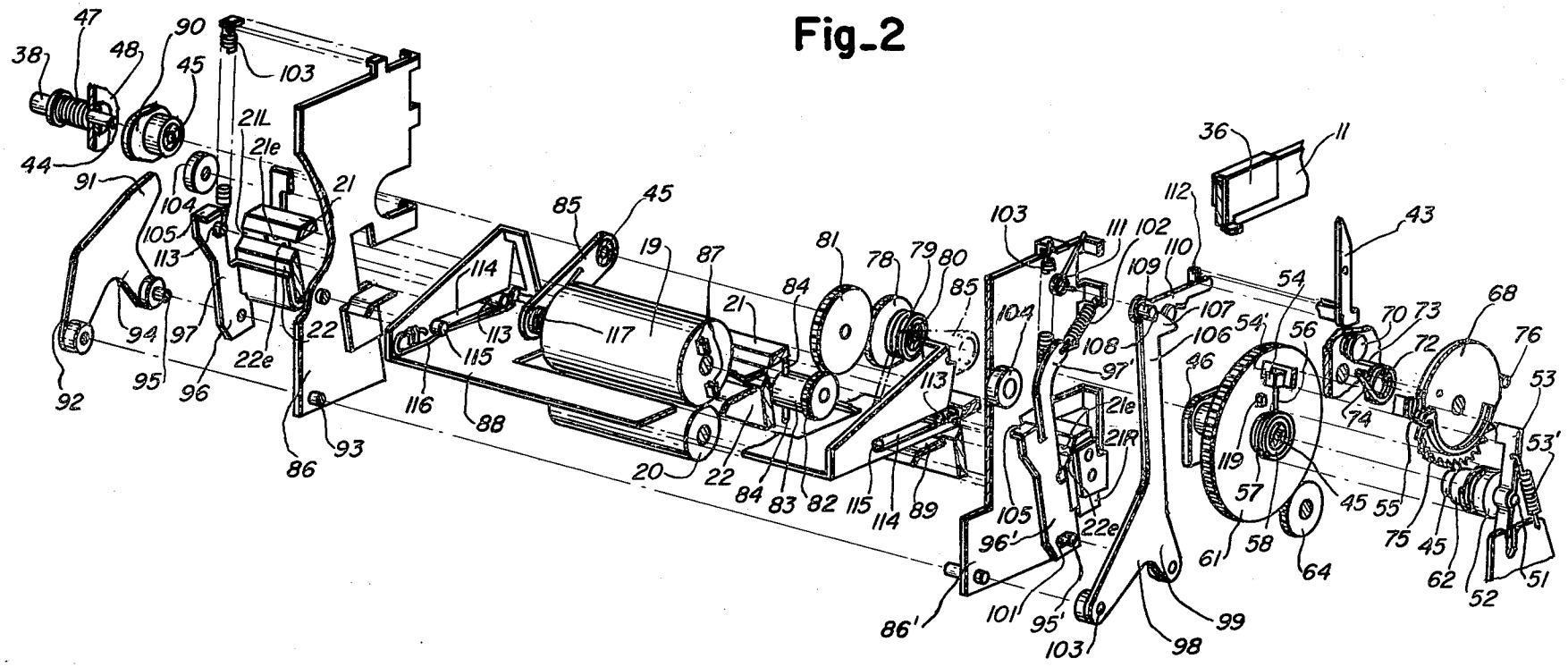
FIG. 2 is a perspective view of the elements of the invention integrated in the machine shown in FIG. 1 including the machine on and copy cycle control button and associated elements to cock a spring-powered knife and feed paper into the machine and shown in active machine on position following depression of a copy button.

More particularly referring to FIG. 2, the copy button 38 is shown secured to one end of a rod 44 which extends through and is axially movable relative to a hollow shaft 45 rotatably supported on machine subframe 46. The rod 44 is biased out by a spring 47 between the copy button and a subframe portion 48. The end 51 of the rod 44 opposite the copy button 38 extends beyond the enlarged hollow shaft end 52 and has secured thereto a blade 53 clockwise biased by a spring 53'. The blade 53 has spaced projections 54 and 54' extending toward the copy button end and a lateral projection 55. The outermost projection 54 normally extends into the path of a bent out end 56 of a clutch spring 57 wrapped around the hub 58 of a gear 61, rotatably mounted on the hollow shaft 45, and around a portion 62 of the hollow shaft 45 outwardly of and of the same diameter as the gear hub 58. Projection 54' serves to catch the spring end should the copy button be held depressed to prevent multiple revolutions of shaft 45; when the button is released, projection 54 again stops the spring 56.

Figure 3:
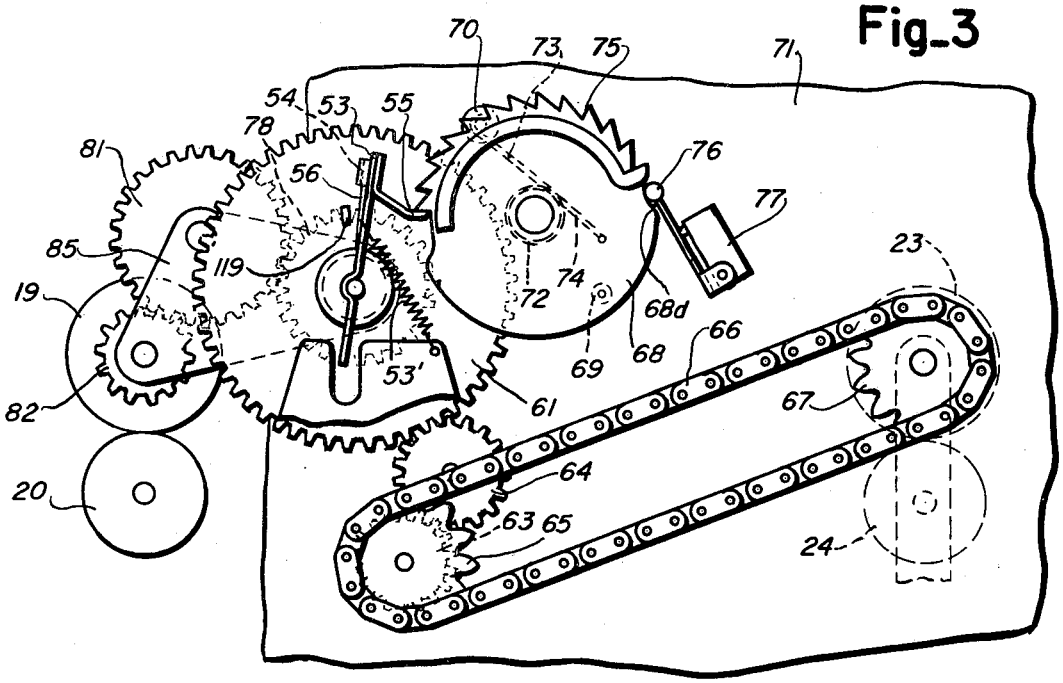
FIG. 3 is a view of the drive which is operative to cock the knife and feed paper, associated with a timer and power on disc, shown in the machine off position.
Figure 4:
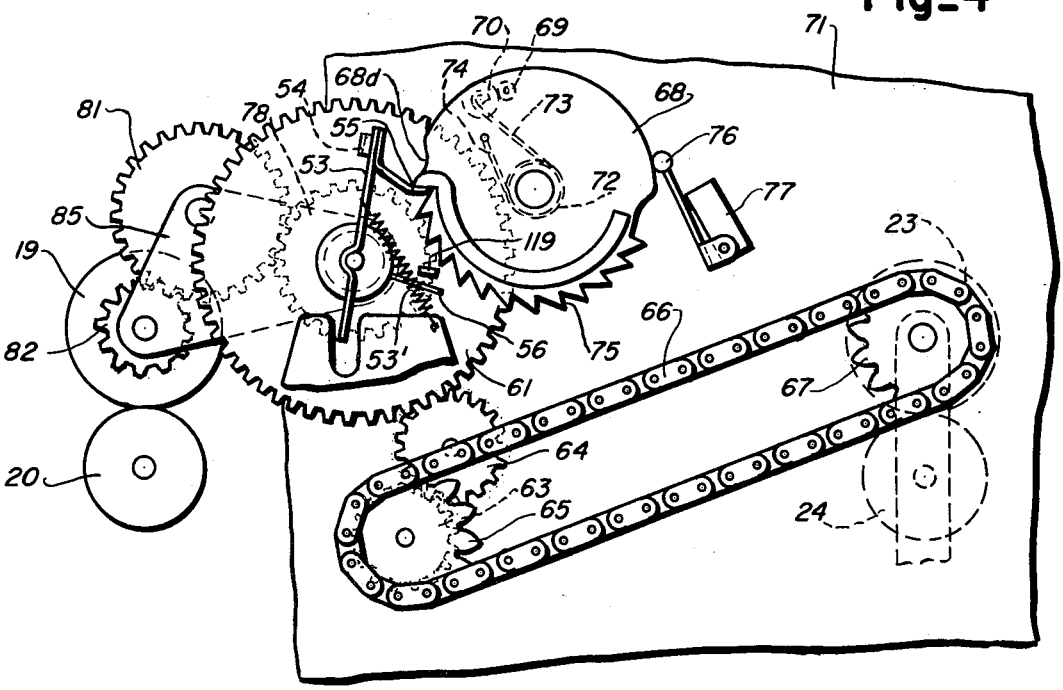
FIG. 4 is a side view similar to FIG. 3 showing the machine on condition.

As shown in FIG. 2 and with particular reference to FIGS. 3 and 4, a motive source comprising a motor driven gear 63 drives an intermediate gear 64 which drivingly engages the gear 61. A sprocket 65 coaxial with the motor driven gear 63 transmits drive via a chain 66 to a sprocket 67 on the shaft of feed roll 23. With more particular reference to FIGS. 3 and 4, there is shown a machine on and timer disc 68 rotatably mounted on subframe portion 71 higher than and to the right of the gear 61 and biased in a counterclockwise direction by a spring 72 mounted about the disc axle with opposite ends 73, 74 secured to the subframe portion 71 and the disc 68. As shown, the disc has teeth 75 over approximately one-half its periphery with the remainder circular over which the arm 76 of a motor or machine on switch 77 rides. As shown in FIG. 3, a depression 68*d* on the circular periphery allows the switch 77 to open.

Returning to FIG. 2, when the copy button 38 is pushed, the projection 54 releases the clutch spring 57 causing it to wrap and couple shaft 45 to gear 61. Also, the lateral projection 55 releases the disc 68 causing it to rotate counterclockwise from the position shown in FIG. 3 until it is arrested at the 180° position shown in FIG. 4 by engagement of a stop lug 69 on the rear side of the disc 68 with a stop 70 on subframe portion 71 with the result that the switch 77 is moved to closed position starting the motive source as shown in FIG. 4. With the motive source on and the clutch spring 57 engaged, the shaft 45 is driven through one revolution until the spring end 56 reencounters the projection 54 causing the clutch spring 57 to open.

Figure 6:
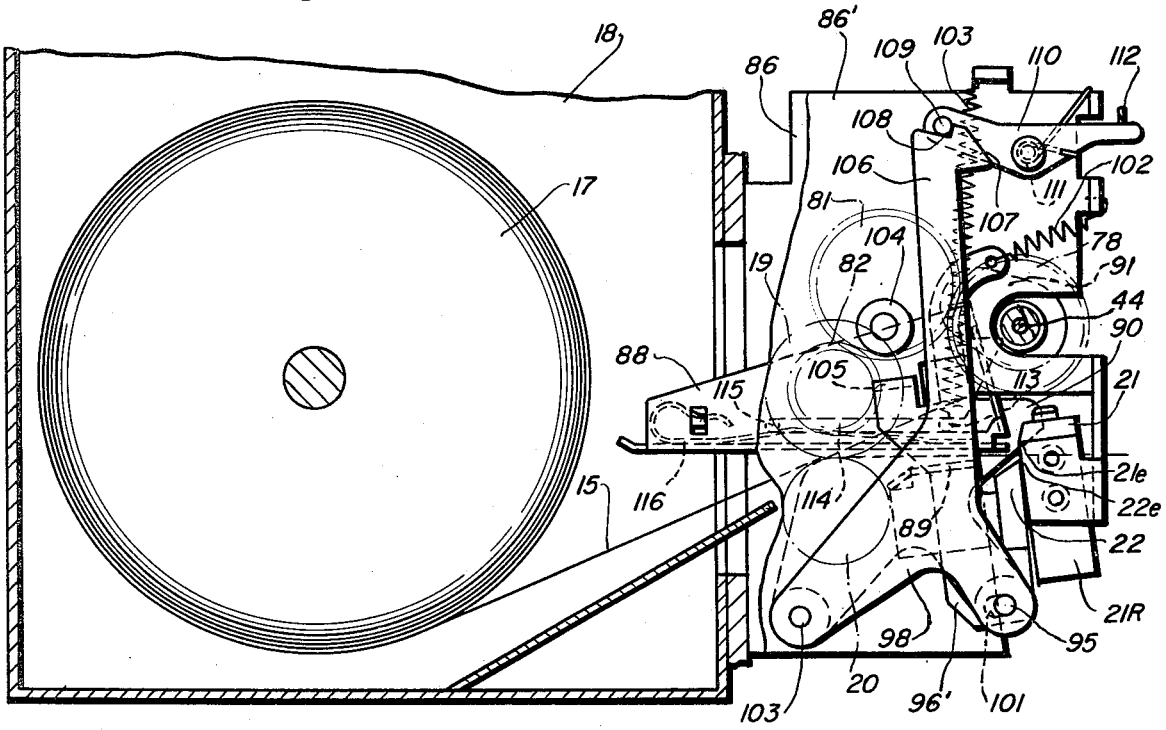
FIG. 6 is a view similar to FIG. 5 showing the elements in cocked position corresponding to FIG. 2.

With reference again to FIG. 2, the rotation of shaft 45 drives a gear 78 rotatably mounted thereon through a one-way clutch spring 79 embracing the shaft 45 and the hub 80 of gear 78. Rotation of the gear 78 is transmitted through an intermediate gear 81 to drive a feed roll gear 82 having a hub 83 from which two 180° spaced posts 84 radially extend. The gears 81, 82 and the upper feed roll 19 are rotatably supported on links 85 supported on the shaft 45 with the lower feed roll rotatably supported on subframe portions 86, 86′. The posts 84 are adapted, following rotation of gear 82 on the order of 120°, during which interval rotation of shaft 45 will have caused the knife 22 to be cocked, to engage and drive 180° spaced lugs 87 axially extending from the feed roll 19, thereby to drive the feed rolls 19, 20 causing paper 15 threaded therethrough to be pulled from the roll 17 between upper and lower paper guides 88 and 89 and between the stationary and movable knives 21 and 22 as shown in FIG. 6 for further transport by the driven feed rolls 23,24. The one-way clutch 79 allows free rotation of gears 82,81,78 by feed rolls 19,20 which continue to be driven, following a revolution of shaft 45, by the paper 15 being drawn through by feed rolls 23, 24 before severance by the knives 21, 22. In this free mode, the lugs 87 on the feed rolls move away from drive posts 84 on drive gear hub 83.

Figure 5:
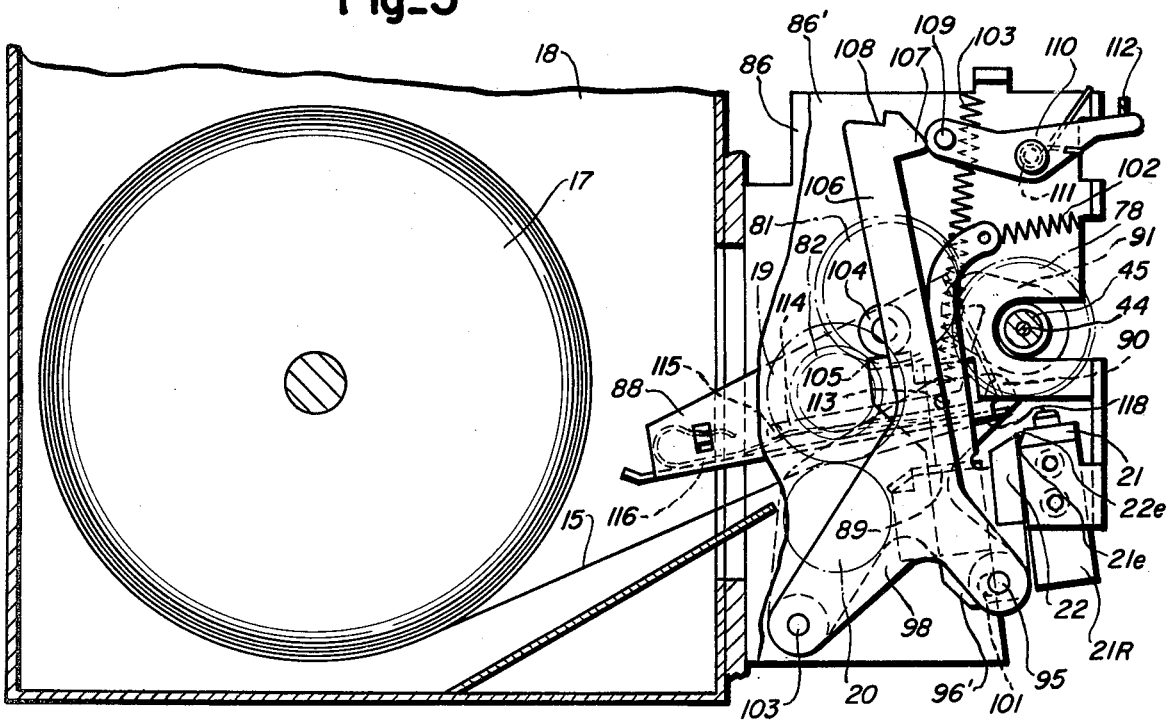
FIG. 5 is a side elevational view of the knife cocking and release elements in uncocked or tripped position.

As noted above, the initial rotation of shaft 45, before feed roll 19 is driven, serves to move and cock the movable knife 22 in a down position relative to the stationary knife 21. As shown in FIGS. 2, 5 and 6, the stationary knife 21 is secured at each end to the top surfaces of left and right movable knife guide blocks 21L, 21R secured to the subframe portions 86, 86′, with the cutting edge 21*e* of the stationary knife 21 at the right end flush with the right guide block 21R and canted slightly forward of the left guide block 21L. The movable knife 22, supported as described below, is inclined from end to end relative to the stationary knife 22, being higher at the right end, with its cutting edge 22*e* making contact with the stationary knife cutting edge 21*e* from right to left as it rises from the position of FIG. 6 to that shown in FIG. 5. The downward movement and cocking of the movable knife 22 is accomplished by a cam 90 secured to the shaft 45 which acts against a follower 91 secured at 92 to one end of a cross shaft 93 rotatably supported in subframe portions 86, 86′. The follower 91 has an extension 94 secured to a pin 95 which extends through a hole in the lower end of, and to downwardly drive, a bracket 96 which is secured to one end of the movable knife 22 and which has an upstanding portion 97. The other end of the cross shaft 93 is also secured to a latch lever 98 which moves with the follower 91. The latch lever 98 has a rearward extension from which a pin 95′, aligned with pin 95, extends through a slot 101 of a second bracket 96′ which is secured to the other end of the movable knife 22. A spring 102 secured to an upstanding portion 97′ of the bracket 96′ and the subframe portion 86′ urges the movable knife 22 into engagement with the stationary knife 21. Knife power springs 103 are secured to the upstanding bracket portions 97, 97′ and subframe portions 86, 86′ and are tensioned when the cam 90 rocks the follower 91, cross shaft 93 and latch lever 98. As the movable knife rises in the manner noted before, cutting from right to left, the slot 101 in bracket 96′ accommodates its movement along the canted stationary knife edge 21*e.* Upstops 104 in the path of lugs 105 on the brackets 96, 96′ serve to limit the upward movement of the movable knife 22. The upper end 106 of the latch lever 98 has a nose 107 and a notch 108 whereby upon its rotation by the cam 90, it is latched by a pin 109 on the end of trip arm 110 biased by a spring 111 in the rotational position as shown in FIG. 6.

As best seen in FIGS. 1 and 2, when the lead edge 41 of the copy paper reaches the exposure station, the switch 42 will be tripped to energize a clutch (not shown) and couple power to move the platen 11, to the right as viewed, in scan direction. When the copy length adjustor 36, which was set to the trailing edge 37 of the original to be copied, encounters the upper end of a lever 43 pivotally mounted on a portion of the machine base 12 and rocks the lever 43, its inwardly directed arm 112 will rock the trip arm 110 clockwise as viewed in FIGS. 2, 5 and 6, and release the latch lever 98 and movable knife 22 for upward movement to cut paper 15. As the movable knife 22 rises, studs 113 extending inwardly from the knife brackets 96, 96′ into slots 114 of the upper paper guide 88, pivot the guide about pivots 115 to which the guide 88 is detentably secured by springs 116. This action of the upper paper guide 88 moves it out of the way of the movable knife 22.

After severance, the feed rolls 19, 20 are no longer rotated by paper being drawn by feed rollers 23, 24 and are therefore released for reverse rotation by a spring 117 wound about the feed roll shaft and hooked to the support 85 thereof; the spring 117 being maintained under limited slipping tension during feeding rotation thereof, thereby to withdraw the lead edge 118 of paper on the roll toward the roll 17. This slight withdrawal of the lead edge 118 thus positions the lead edge 118 for movement past the knives 21 and 22 to the feed rolls 23, 24 when next the knife 22 is cocked and thereby avoids curling of the lead edge permitting free entry between the separated knives 21 and 22.

Also, after severance, the paper 15 downstream of the knives 21 and 22 continues through the exposure station 16 and the passage of its trailing edge is detected by switch 42 whereupon the forward scan clutch is deenergized to allow return of the platen 11 to a beginning of scan position as shown in FIG. 1, in any conventional manner, as by continuously driving the platen 11 in return direction through a slip clutch as described in said aforementioned Service Guide, or by energizing a reverse drive clutch.

As hereinbefore noted, after a revolution of the shaft 45, it is decoupled from the gear 61 as shown in FIG. 2 which continues to be driven by the motor. As best seen in FIG. 2, a lug 119 is provided on the face of gear 61 at a position to engage a ratchet tooth 75 each revolution and index the disc 68 clockwise with the lateral projection 55 serving to retain the disc 68 in each serial indexed position. Thus, if the copy button 38 is not pushed for a number of revolutions of the gear 61, the disc 68 wll be rotatively indexed until the motor switch arm 76 reaches the depression **68*d* turning off the motor. If the copy button 38 is pushed at any time before the disc 68 has been indexed to the motor or machine off position, the disc 68 will be released back to the starting time position shown in FIG. 4. Should the machine be in a multi-copy mode initiated by a single button depression, return movement of the platen acting on mechanism set by the multi-copy dial (not shown) would serve to operate rod 44** and reestablish the timing.

While the roll feed and knife assembly are shown in connection with a machine employing photosensitive copy paper, it is to be understood that the instant invention could be incorporated as well in a plain paper copier in place of the sheet feed mechanism as are found in such machines.

The invention claimed is:

1. In a copy machine having a frame,
a roll of copy paper supported on said frame,
a pair of frame supported feed rolls for moving copy paper from said roll, said feed rolls having an entry side and an exit side,
a stationary knife and a normally uncocked movable knife positioned on the exit side of said feed rolls,
a spring connecting said movable knife to said frame,
a motive source,
a depressible copy control means for initiating a copy cycle,
first means responsive to a first depression of said copy control means for energizing said motive source,
a knife cocking and paper feed shaft,
a single revolution clutch engageable in direct response to each depression of said copy control means for coupling said energized motive source and shaft,
means on said shaft for moving said movable knife against said knife spring to a cocked position,
means to latch said movable knife in cocked position whereby copy paper fed by said feed rolls may move between said stationary and cocked knives,
means coupling said shaft to drive said feed rolls after said movable knife has been cocked and latched,
and means on said frame responsive to the trailing edge of an original to be copied for releasing said latch means to enable said movable knife to cut copy paper between said stationary and movable knives.

2. A copy machine as recited in claim 1, said means coupling said shaft to said feed rolls comprising a one way clutch.

3. A copy machine as recited in claim 1, said means for moving said movable knife against said knife spring including a cam on said shaft, and a cam follower coupled to drive said movable knife against its spring.

4. A copy machine as recited in claim 2, said means coupling said shaft to said feed rolls including a delayed action coupling to allow time for said movable knife to be cocked and latched before said feed rolls draw copy paper from said roll of copy paper.

5. A copy machine as recited in claim 1,
including upper and lower paper guides, said upper guide being pivotally mounted on said frame and extending to the cutting edge of said movable knife,
and means coupling said upper guide to said movable knife whereby the leading edge of paper at the exit side of said feed rollers can move away from said movable knife after being severed, and on movement of said movable knife back to cocked position can be restored opposite the opening between the stationary knife and the recocked movable knife without curling.

6. A copy machine as recited in claim 5, wherein the entry angle to said feed rollers of said paper is positioned to accommodate pivoting movement of said upper guide.

7. In a copy machine having a frame,
an original supporting platen mounted for movement on said frame,
a member on said platen settable opposite the trailing edge of an original placed on said platen for copying,
a roll of copy paper supported on said frame,
a pair of frame supported feed rolls for moving paper from said roll, said feed rolls having an entry side and an exit side,
a stationary knife and a movable knife positioned on the exit side of said feed rolls,
a spring connecting said movable knife to said frame,
a motive source,
a single depressible copy control means for initiating a copy cycle,
first means responsive to a first depression of said copy control means for energizing said motive source over an interval longer than a copy cycle and for deenergizing said motive source if said copy control means is not again depressed within a predetermined time after completion of a first initiated cycle,
second means responsive to each depression of said copy control means for first moving said movable knife against said knife spring to a cocked position and for thereafter coupling said energized motive source to said feed rolls, whereby paper fed by said feed rolls may move between said knives,
means to latch said movable knife in cocked position whereby paper fed by said feed rolls may move between said stationary and cocked knives,
and means on said frame in the path of said positioned member for releasing said means latching said movable knife thereby to cut paper between said stationary and movable knives.

8. In a copy machine having a frame,
a roll of copy paper supported on said frame, a pair of frame supported feed rolls for moving paper from said roll, said feed rolls having an entry side and an exit side, a stationary knife and a movable knife positioned on the exit side of said feed rolls, a spring connecting said movable knife to said frame, a motive source, a depressible copy control means, first means responsive to depression of said copy control means for energizing said motive source, second means responsive to depression of said copy control means for moving said movable knife against said knife spring to a cocked position and for coupling said energized motive source to said feed rolls, whereby paper fed by said feed rolls may move between said knives, means to latch said movable knife in cocked position whereby paper fed by said feed rolls may move between said stationary and cocked knives, said first means for energizing said motive source comprising a disc, a spring biasing said disc in one direction, said copy control means normally holding said disc in a home position against movement by said spring and acting on depression to release said disc, and switch means operative in response to movement of said disc from home position to energize said motive source.

9. A copy machine as recited in claim 8, including means on said motive source for indexing said disc back to a home position.

10. In a copy machine, a motive source for driving mechanism to produce a copy of an original on copy paper, operator depressible means for energizing said motive source including a disc, a spring biasing said disc for rotation in one direction, said operator depressible means normally holding said disc against rotation in a home position against movement by said spring and acting when depressed to release said disc, switch means responsive to movement of said disc from home position for energizing said motive source, means for limiting rotation of said released disc after rotation through a predetermined arc to a limit position comprising an abutment on said disc and a stop finger on said operator depressible means, and means driven by said energized motive source for indexing said disc to return it to home position after a predetermined time interval, said operator depressible means operative on each depression to release said disc positioned intermediate said home and said limit positions to said limit position.

* * * * *